US009204688B2

(12) United States Patent
Hazarian

(10) Patent No.: US 9,204,688 B2
(45) Date of Patent: Dec. 8, 2015

(54) PRE- AND POST-PEDICURE FOOTWEAR APPARATUS

(71) Applicant: Natasha Virginia Hazarian, El Paso, TX (US)

(72) Inventor: Natasha Virginia Hazarian, El Paso, TX (US)

( * ) Notice: Subject to any disclaimer, the term of this patent is extended or adjusted under 35 U.S.C. 154(b) by 349 days.

(21) Appl. No.: 13/801,463

(22) Filed: Mar. 13, 2013

(65) Prior Publication Data

US 2014/0259772 A1 Sep. 18, 2014

(51) Int. Cl.

| | |
|---|---|
| ***A43B 3/26*** | (2006.01) |
| ***A43B 13/28*** | (2006.01) |
| ***A43B 3/12*** | (2006.01) |
| ***A43B 23/24*** | (2006.01) |
| ***A43B 3/10*** | (2006.01) |

(52) U.S. Cl.
CPC ..... *A43B 23/24* (2013.01); *A43B 3/105* (2013.01); *A43B 3/26* (2013.01)

(58) Field of Classification Search
CPC ..... A43B 23/24; A43B 3/10; A43B 3/12; A43B 3/103; A43B 3/105; A43C 11/24
USPC ..... 36/11.5, 94, 136
See application file for complete search history.

(56) References Cited

U.S. PATENT DOCUMENTS

| | | | | |
|---|---|---|---|---|
| D260,047 | S | 8/1981 | Heinz | |
| D271,156 | S | 11/1983 | Williamson | |
| 8,806,783 | B2 * | 8/2014 | Chase et al. | 36/136 |
| 2007/0011915 | A1 | 1/2007 | Allen | |
| 2009/0249650 | A1 * | 10/2009 | Sarantakos | 36/101 |
| 2009/0313854 | A1 * | 12/2009 | Clarke | 36/97 |
| 2011/0035962 | A1 | 2/2011 | Sabounjian | |
| 2011/0056091 | A1 * | 3/2011 | Shmurak et al. | 36/101 |
| 2011/0173843 | A1 * | 7/2011 | Bishop | 36/92 |
| 2011/0277345 | A1 * | 11/2011 | Luiz | 36/11.5 |
| 2012/0066930 | A1 | 3/2012 | Matsuo | |
| 2013/0047387 | A1 * | 2/2013 | Gervase | 24/586.11 |

* cited by examiner

*Primary Examiner* — Jila M Mohandesi
(74) *Attorney, Agent, or Firm* — Braxton, Hilton & Perrone, PLLC

(57) ABSTRACT

An article of footwear for use before and after a pedicure including a toe separator, strap securing mechanisms and an offset toe stem adapter end for connecting straps of footwear to the foot without compromising or damaging pedicured toenails.

11 Claims, 3 Drawing Sheets

PRE- AND POST-PEDICURE FOOTWEAR APPARATUS

FIELD OF THE TECHNOLOGY

The present application relates generally to a footwear apparatus suitable for pre- and post-pedicure use, and specifically to a footwear apparatus suitable for normal wear before receiving a pedicure that also prevents contact or damage to wet nail polish or varnish applied to toenails during a pedicure that occurs during insertion of the foot into a sandal after completion of the pedicure.

BACKGROUND

Today, consumers constantly search for ways to improve their appearance. One such activity that will further the goal of enhanced appearance is a pedicure. Whether performed by oneself or through a service provider, a pedicure can be a time-consuming task, but one considered worth it by the recipient in exchange for a clean, sophisticated appearance of one's toes. A frustrating by-product, however, for the recipient of the pedicure is that after painstaking effort to carefully complete the task that typically includes removing old polish, trimming, filing, buffing, and applying several layers of new polish one wrong move can ruin the pedicure and cause either the recipient or the service provider to start the pedicure process again on the affected toes. One such act that may ruin the experience is the act of re-inserting the foot into a shoe or sandal after the pedicure is complete but the polish or varnish applied to the nails is not completely dry. Those having a pedicure often wear inexpensive sandals, such as a flip-flop, to a spa where the pedicure will be received. The thought is that the flip-flop has an open toe arrangement that appears to provide an easy avenue for inserting treated yet wet nails back into the sandal. In this manner, the user may leave the spa or salon without going barefoot. A problem with the flip-flop or similar inexpensive sandals for this purpose is its design. The typical flip-flop has an inverted y-shaped strap configuration. While on the surface this configuration appears conducive to inserting the foot into the sandal without damaging treated toenails, an opposite result often occurs. Because the space between the flip-flop's straps and the platform of the sandal is small, much care is required to insert the foot completely into the flip-flop without scraping the toenails on the strap. When one receives a pedicure at a spa or salon, it is typically by appointment and the salon has many appointments scheduled throughout the day. As a result, once the customer receives the pedicure, she generally does not wait for her nails to completely dry. Instead, the customer must leave the pedicure station as the next customer is typically waiting. Even those performing their own pedicure often don't have time to wait for the toenails to dry. It is at this point, the recipient of the pedicure must place her foot back into the flip-flop or sandal, often with difficulty. This is when the nails are most susceptible to coming into contact with the sandal straps, thus damaging or removing the applied polish and creating the need to, in whole or in part, again perform the polish application on the affected toes.

Consequently, there is a need for footwear, such as a fully functional sandal, that the recipient of a pedicure may wear in the ordinary course before and after the pedicure is applied. A single sandal that is acceptable visually and functionally to wear as one travels to the pedicure salon or in the ordinary course of the day and that is easily donned and worn after the pedicure process while alleviating the chance of damaging pedicured nails is presented.

BRIEF DESCRIPTION OF THE DRAWINGS

For a more complete understanding of the present embodiments and their advantages, reference is now made to the following description taken in conjunction with the accompanying drawings, in which like reference numerals represent like parts.

DETAILED DESCRIPTION OF THE EMBODIMENTS

FIGS. 1-8, discussed below, and the various descriptions of the embodiments disclosed herein are by way of illustration only and should not be construed as limiting. Those skilled in the art will understand that the principles of the present disclosure may be implemented in a suitable pedicure footwear apparatus.

Figure 1:
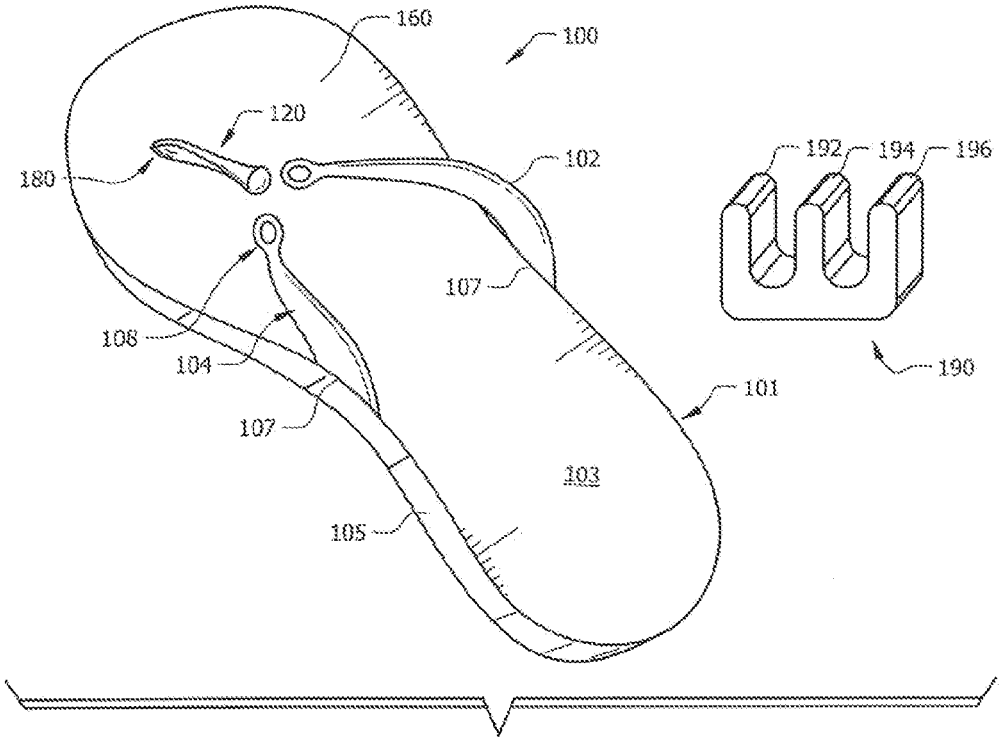
FIGS. 1 and 1A provide perspective views of an embodiment of the present pre- and post-pedicure footwear apparatus.

FIG. 1 depicts an exemplary embodiment of the present pre- and post-pedicure footwear apparatus. In FIG. 1, sandal 100 is shown that includes a sole 101 having an upper section 103 and a side wall section 105. Affixed to sole 101 are straps 102 and 104. Each strap 102 and 104 has a lower end 107 that is affixed to sole 101 at the juncture of sole upper section 103 and side wall section 105. The lower end 107 of each strap 102 and 104 may be affixed to the sole 101 at the juncture with glue or any suitable fastening device known in the art.

Figure 1A:
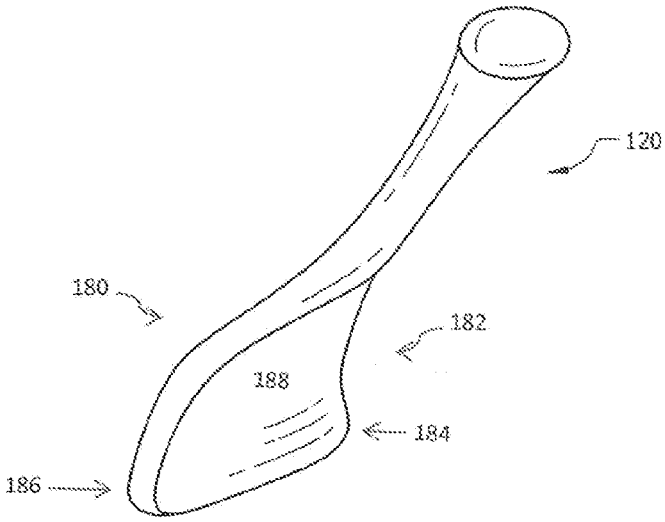

Straps 102 and 104 each have an upper or distal end 108 that includes a substantially circular loop. As will be discussed, loops 108 facilitate inserting and removing the foot from sandal 100 after a pedicure in a manner that prevents damage to the freshly painted and treated toenails. At the front end of sandal 100 on the upper section 103 of sole 101 is inserted toe stem 120. Toe stem 120 extends upwardly from sole upper section 103 and is inserted through a receiving hole (not shown) within sole 101. The diameter of the shaft of toe stem 120 is approximately equal to the diameter of the receiving hole, causing toe stem 120 to remain secure. At the lower end of toe stem 120 is toe separator 180. FIG. 1A provides an enlarged view of toe stem 120 and toe separator 180. As seen in FIG. 1A, toe separator 180 includes a base area 182. Base area 182 includes a rearward facing portion 184 that is wider than a forward facing portion 186. Lateral sides 188 of toe separator 180 are contoured for user comfort. Toe separator 180 serves to keep the large toe separated from the second toe to prevent the toenails of those toes from coming into contact with one another and damaging the recently polished nails. Toe separator 180 (depicted in more detail in FIGS. 2 and 3) may be integrally formed as part of toe stem 120 or may be a separate unit that is attached to the shaft of toe stem 120. In one embodiment, toe separator 180 is fabricated from a foam material and may be contoured according to the spacing between the large and second toes to promote comfort.

In an outward direction on sole 101, upper section 103 from toe stem 120 is toe spacer slot 160. Toe spacer slot 160 is a recessed slot within sole upper section 103 of sole 101 for receiving a multiple toe spacer 190. The multiple toe spacer 190 consists of a single unit flexible foam construction or other suitable construction. Individual tines 192, 194 and 196 of toe spacer 190 are inserted between the second and third, third and fourth, and fourth and fifth toes to maintain separation between the toes and further prevent damage to the polished toe nails. Recessed slot 160 has a width and length substantially similar to the width and length of the base of the multiple toe spacer 190. Recessed slot 160 has a depth that enables insertion of a multiple toe spacer 190 which in turn allows the user to comfortably walk in sandal 100 while the multiple toe spacer 190 is in place. The combination of toe separator 180 and the multiple toe spacer 190 inserted in slot 160 provides the wearer with the ability to comfortably walk in the sandal 100 post-pedicure while providing necessary toe separation to avoid damaging the polished toes.

As discussed above, straps 102 and 104 each include a loop 108. Loop 108 serves to removably secure straps 102 and 104 to toe stem 120. In use, to secure the straps 102 and 104 of sandal 100 on the foot, loop 108 of strap 102 is aligned with the upper end of toe stem 120 so as to allow the upper end of toe stem 120 to be inserted through said loop 108. Once the upper end of the toe stem 120 is received by said loop 108 the straps 102 and 104 are ready to be secured.

Figure 2:
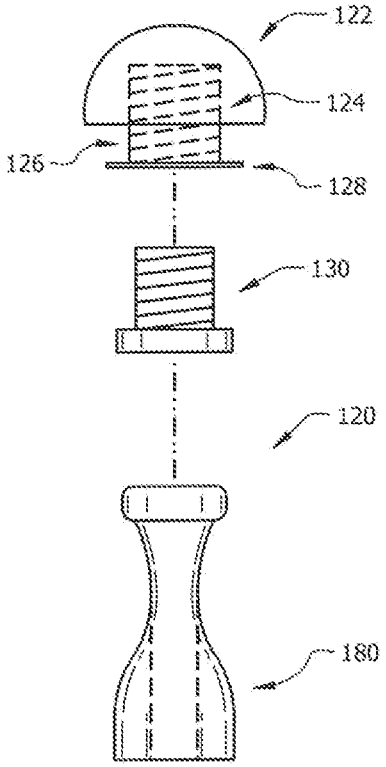
FIGS. 2 and 3 are perspective views of various embodiments of a toe-stem apparatus of the pre- and post-pedicure footwear apparatus.
Figure 3:
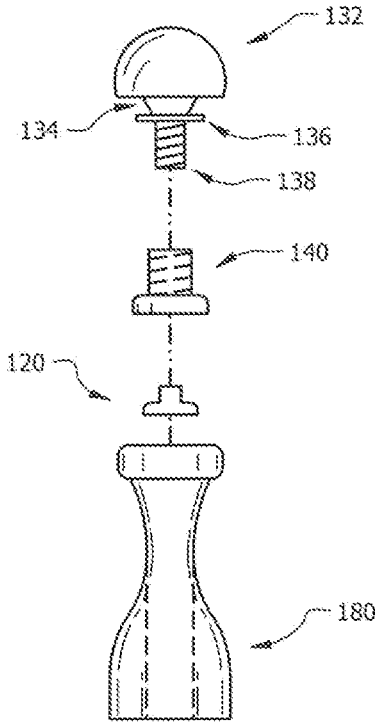

The securing apparatus for each loop 108 of straps 102 and 104 may be understood through reference to FIGS. 2 and 3. FIG. 2 is one embodiment of the securing cap 122 of toe stem 120. In FIG. 2, toe stem 120 includes toe separator 180 integrally formed with the lower section of the shaft of toe stem 120. A toe stem cap 122 is provided to maintain the position of the upper end of toe stem 120 within loops 108. The upper end of toe stem 120 is a threaded end 130. Shown in FIG. 2 is a gap 126 formed between stopper 128 and recessed threaded aperture 124. Each loop 108 has an inner diameter greater than the diameter of the shaft of threaded end 130 but less than the diameter of stopper 128. Loop 108 of strap 104 is positioned in gap 126 to secure the cap 122 to the sandal and, therefore, prevent loss of the cap 122. Within toe stem cap 122 is a recessed threaded aperture 124 for receiving threaded end 130. In order to secure toe stem cap 122 onto threaded end 130, toe stem cap is placed atop of threaded end 130 and rotated clockwise to engage the threads of threaded end 130 and the threads of recessed threaded aperture 124.

In FIG. 2, threaded end 130 may be formed of a single body construction of the same material as the body of toe stem 120. Alternatively, threaded end 130 may be manufactured separately from toe stem 120 and secured to the upper end of toe stem 120 through use of a fastener, such as a rivet, or by use of adhesive.

FIG. 3 depicts an alternative embodiment of toe stem 120. In FIG. 3, toe stem cap 132 includes a threaded end 138 and a stopper 136. Loop 108 of strap 104 is positioned in gap 134 to secure the cap 132 to the sandal and, therefore, prevent loss of the cap 132. Threaded end 138 is received by an interior threaded nut section 140. Nut section 140 is affixed to the upper end of the shaft of toe stem 120 with a fastener, such as a rivet, or by use of adhesive.

In operation, a user may wear sandal 100 to a salon to receive a pedicure. Before the pedicure is performed, the user may simply slip off the sandal in the customary way as there is no concern of damaged toe nails before the pedicure. Once the pedicure is complete and there is a concern of damaging the newly polished nails, the user may disengage straps 102 and 104 from toe stem 120. With reference to FIG. 2, this is achieved by twisting toe stem cap 122 in a counter-clockwise direction causing the threads of threaded end 130 of toe stem 120 and the internal threads of recessed threaded aperture 124 to disengage. Straps 102 and 104 may be removed away from toe stem 120 by removing loops 108 from the upper end of toe stem 120 and moved away from the area of sandal 100 that will be occupied by the user's foot. At this point, the user may have placed, prior to the polish application, the multiple toe spacer 190 situated appropriately between the second and fifth toes of each foot. The user may then insert the bottom portion of the multiple toe spacer 190 that extends laterally across the foot beneath the toes into slot 160. In conjunction with this, the user may carefully extend the large toe and second toe on each side of toe separator 180 at the lower portion of toe stem 120. At this juncture, all of the user's toes maintain separation.

The user now secures straps 102 and 104 in order to comfortably and effectively wear sandal 100 to enable walking. Toe stem 120 extends in a direction from the toe area of sandal 100 to the heel area of sandal 100. As such, the upper end of toe stem 120 over which loops 108 of straps 102 and 104 are placed are located away from the freshly pedicured toes of the user, further preventing the chance of damage to the nails. Loops 108 are passed over the upper end of toe stem 120, thus causing straps 102 and 104 to secure sandal 100 to the foot. Loops 108 are secured in place by inserting the threaded end 130 of toe stem 120 into the recessed threaded aperture of toe stem cap 122 and twisting toe stem cap 122 in a clockwise direction to engage the threads of the two bodies and secure toe stem cap 122 onto the upper end of toe stem 120. In this manner, the sandal 100 is secured to the foot but at no time were the freshly manicured toes of the user susceptible to damage caused by the toenails coming in contact with the straps 102 and 104 or other parts of the sandal 100.

With reference to the toe stem embodiment depicted in FIG. 3, the process of situating the straps 102 and 104 to secure the foot within the sandal is largely the same. With respect to the toe stem in FIG. 3, however, the toe stem cap 132 includes a threaded end 138 that is inserted into the nut section 140 that is located at the upper end of the shaft of toe stem 120. Similar to the embodiment of the toe stem assembly of FIG. 2, the toe stem cap 132 of FIG. 3 is secured within nut section 140 by twisting cap 132 in a clockwise direction. As a result, the upper shaft of toe stem 120 is secured within loops 108 of straps 102 and 104. Loop 108 of strap 104 is positioned in gap 134 to secure the cap 132 to the sandal and, therefore, prevent loss of the cap 132. Strap 104 is thus fixed to the sandal 100 at gap 134. Stopper 136 limits penetration of threaded end 138 into nut section 140, thus preventing over-tightening of cap 132 in a manner that may cause cap 132 to crack.

Figure 4:
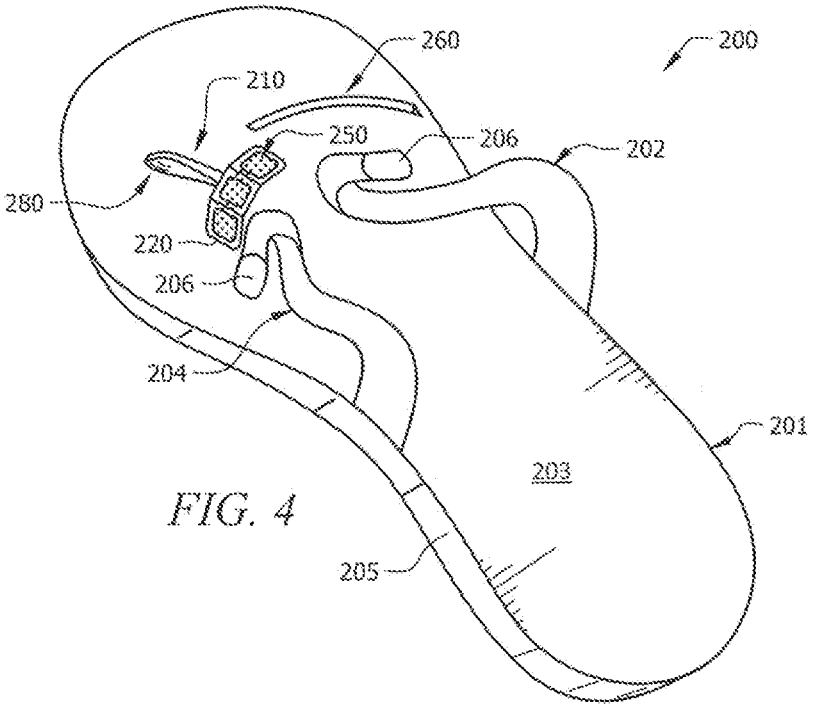
FIG. 4 is a perspective view of an embodiment of the present pre- and post-pedicure footwear apparatus.
Figure 5:
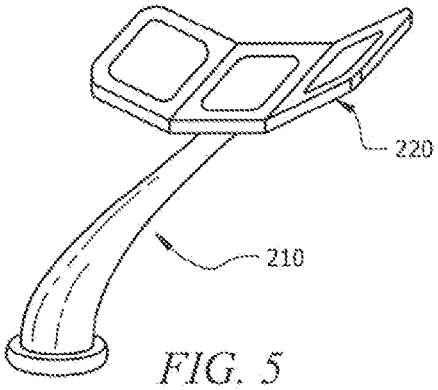
FIGS. 5, 6, 7, and 8 are perspective views of various embodiments of a fastener apparatus of the pre- and post-pedicure footwear apparatus.

An alternative embodiment of the present footwear apparatus is depicted in FIGS. 4-8. In FIG. 4, sandal 200 includes a sole 203 and straps 202 and 204. Sandal 200 also includes a sidewall section 205 that spans the perimeter of sole 203. Straps 202 and 204 are affixed to sandal 200 at the juncture of sole 203 and sidewall section 205. Straps 202 and 204 may be affixed by sewing, adhesive or any other suitable technique known in the art.

Sandal 200 includes a toe stem 210 having a buckle 220 affixed to an upper end. An expanded view of toe stem 210 with buckle 220 is provided as FIG. 5. Toe stem 210 includes an integrated toe separator 280 formed within the lower portion of toe stem 210. The toe separator 280 may be integrally formed as part of toe stem 210 or may be a separate unit that is attached to the shaft of toe stem 210. In one embodiment, toe separator 280 is fabricated from a foam material to promote comfort. Toe separator 280 is located on a point on sole 203 where it may occupy the space between the large and second toes of the foot of one wearing sandal 200.

In an outward direction on sole 203 from toe stem 210 is toe spacer slot 260. Toe spacer slot 260 is a recessed slot 260 within sole 203 for receiving a multiple toe spacer. The multiple toe spacer 190 (see FIG. 1) of a single unit flexible foam construction or may be constructed from other suitable material. Individual tines 192, 194 and 196 of toe spacer 190 are inserted between the second and third, third and fourth, and fourth and fifth toes to maintain separation between the toes and further prevent damage to the polished toe nails. Recessed slot 260 has a width and length substantially similar to the width and length of multiple toe spacer 190. Recessed slot 260 has a depth that enables insertion of the base of the multiple toe spacer 190, which in turn allows the user to comfortably walk in sandal 200 while the multiple toe spacer 190 is in place. The combination of toe separator 280 and the multiple toe spacer 190 inserted in slot 260 provides the wearer with the ability to comfortably walk in the sandal 200 post-pedicure while providing necessary toe separation to avoid damaging the polished toes.

In one embodiment of the present pre- and post-pedicure footwear apparatus, a butterfly buckle 220 is affixed to the upper end of toe stem 210. A detailed depiction of butterfly buckle 220 is provided in FIG. 6. Butterfly buckle 220 includes a left wing 222, a right wing 224, and a center mount section 226. Center mount section 226 includes a recessed area 228. The butterfly buckle may be manufactured of molded plastic, metal or other suitable material. Butterfly buckle 220 is affixed to the upper end of toe stem 210 through use of a rivet, adhesive or other suitable fastening device.

Figure 6:
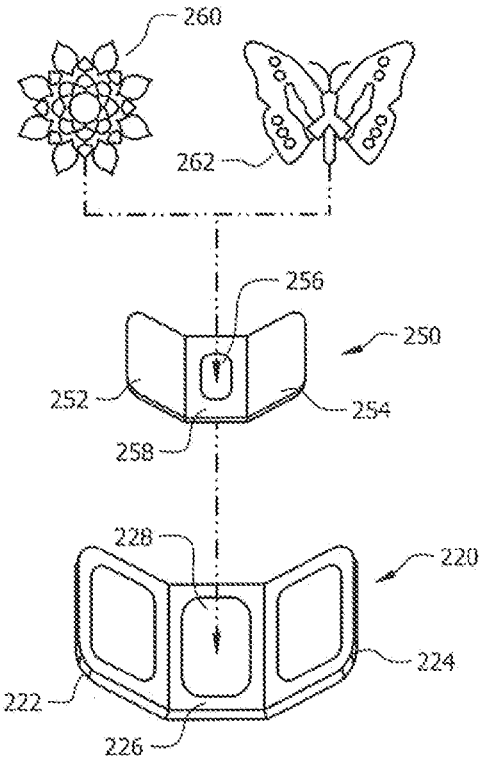

Further in FIG. 6, an ornament platform 250 is shown. Ornament platform 250 is constructed having a substantially similar profile as butterfly buckle 220, yet is of smaller surface area. Ornament platform 250 includes a left wing 252 and a right wing 254 and a center post section 256. Center post section 256 includes a post 258 extending from underneath the ornament platform 250 that is of similar profile and dimension as recessed area 228 of center mount section 226. Recessed area 228 is sized to receive post 258, permitting ornament platform 250 to attach into place on top of and within butterfly buckle 220.

Figure 7:
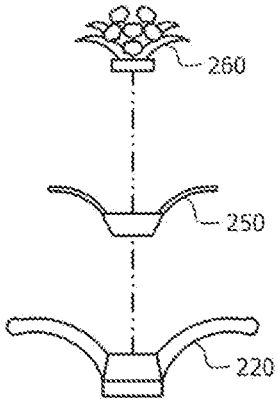

Ornament platform 250 may be manufactured of molded plastic, metal or other suitable material. In one embodiment, the post 258 within center post section 256 that extends from underneath the ornamental platform 250 at the same time forms its own corresponding recessed area on the upper side of center post section 256. This permits an ornamental feature, such as a fabricated gemstone 260 or a butterfly 262 to be snapped or attached onto ornament platform 250. On the lower side or underneath gemstone 260 or butterfly 262 is a post (not shown) that is received by the recessed area formed on the upper side of center post section 256 as a result of fabrication of post 258. This serial connection of gemstone 260 to ornamental platform 250, which in turn is connected to butterfly buckle 220 is shown in FIG. 7. Alternatively, decorative items such as gemstone 260 or butterfly 262 may be affixed to ornamental platform 250 by an adhesive or other suitable fastening device.

Figure 8:
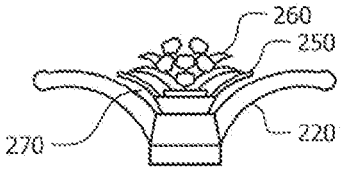

An assembled gemstone 260, ornamental platform 250 and butterfly buckle 220 is depicted in FIG. 8. Shown in FIG. 8 is a gap 270 formed between left and right wings 252 and 254 of ornamental platform 250 and the left and right wings 222 and 224 of butterfly buckle 220. Sandal 220 is worn prior to the receipt of a pedicure as any sandal would be worn in the ordinary course. Notably, prior to receiving a pedicure, the foot is removed from sandal 200 without regard for removal of the straps in any fashion because there is no concern of damage to the toenails. Following the user's receipt of a pedicure, however, the straps 202 and 204 of sandal 200 are disengaged in order to permit insertion of the foot without causing damage to the freshly completed pedicure.

In an exemplary embodiment of the sandal of FIG. 4, on distal ends of straps 202 and 204 may be applied sections 206 of commercially available hook and loop material, such as "Velco", allowing straps to be self-securing about the wings 222 and 224 of butterfly buckle 220 by folding each of strap 202 and 204 to the corresponding wings 222 and 224. In use, the user disengages the straps 202 and 204 of sandal 200 as follows. First, the user separates the hook and loop material of sections 206 of straps 202 and 204 from itself and unfolds straps 202 and 204 that were previously folded about wings 222 and 224. Next, the user removes straps 202 and 204 from butterfly buckle 220 by pulling straps 202 and 204 away from butterfly buckle 220 in a manner that causes the detached ends of straps 202 and 204 to exit the associated gap 270 formed between butterfly buckle 220 and ornament platform 250. Once the straps fully exit the wings 222 and 224 of butterfly buckle 220, the straps are removed away from sole 203. At this juncture, the user may have placed prior to the polish application a multiple toe separator 190 inserted between the second and fifth toes, beneath the toes and laterally positioned across the toes. In order to comfortably and effectively walk in the sandal, the lower end of the multiple toe separator 190 is inserted in slot 260. Contemporaneously with this insertion, toe separator 280 at the lower end of toe stem 210 is situated between the large and second toes. In this manner, freshly polished toenails are isolated from one another to prevent one toe from smearing or damaging polish on another.

As shown in FIG. 4, the toe stem 210 is constructed in a curved manner. Accordingly, the lower end of toe stem 210 is affixed to sole 203 at one point near where the toes will occupy sandal 200, and the upper end of toe stem 210 is offset towards the heel end of sandal 200. This configuration maintains the buckle area and the activity associated with strapping the sandal to the foot away from the freshly pedicured toenails, further reducing the likelihood of scraping or damaging the polish.

Once the straps 202 and 204 are removed from butterfly buckle 220 and away from sandal 200, the user's foot is inserted into sandal 200, and all toe separators are in place, the user may then secure straps 202 and 204 about the foot. At this juncture, the detached ends of straps 202 and 204 are reinserted through the bottom or sole-facing side of wings 222 and 224 of butterfly buckle 220 and pulled up through the wings 222 and 224 via gaps 270. As the gaps 270 have a width substantially similar to the thickness of straps 202 and 204, straps 202 and 204 will not easily exit butterfly buckle 220 and will remain secured. If the straps 202 and 204 include the aforementioned hook and loop sections 206, the detached ends of straps 202 and 204 are effectively self-securing when the ends of straps 202 and 204 are folded over the butterfly buckle wings and onto themselves.

ADDITIONAL DISCLOSURE

The following clauses are offered as further description of the disclosed invention.

1. A footwear apparatus, comprising:

a platform having a top section, a bottom section, and a side wall;

a first strap associated with the platform, said first strap having a proximal end and a distal end;

a second strap associated with the platform, said second strap having a proximal end and a distal end;

a first aperture associated with the distal end of the first strap;

a second aperture associated with the distal end of the second strap;

a stem associated with the top section of the platform, said stem having a threaded upper end;

a stem cap having a threaded section; and a recessed slot formed in the top section sized for receipt of a multiple toe separator.

2. The footwear apparatus according to any preceding clause, wherein the threaded upper end of the stem is receivable by an interior threaded section of the stem cap.

3. The footwear apparatus according to any preceding clause, wherein the threaded section of the stem cap is receivable by an interior threaded upper end of the stem.

4. The footwear apparatus according to any preceding clause, further comprising a stopper associated with the stem cap, wherein the stopper provides a lower boundary of a gap.

5. The footwear apparatus according to clause 4, wherein at least one of the distal end of the first strap and the second strap occupies the gap when the stem cap is engaged with the threaded upper end of the stem.

6. The footwear apparatus according to clause 4, wherein the at least one of the distal end of the first strap and the second strap occupies the gap when the stem cap is disengaged from the threaded upper end of the stem.

7. The footwear apparatus according to any preceding clause, wherein the stem includes a tapered base section having a rear facing width greater than a forward facing width.

8. The footwear apparatus according to clause 7, wherein the tapered base section is offset from the threaded upper end of the stem along a longitudinal axis of the platform.

9. A footwear apparatus, comprising:

a platform having a top section, a bottom section, and a side wall;

a first strap associated with the platform, said first strap having a proximal end and a distal end;

a second strap associated with the platform, said second strap having a proximal end and a distal end;

a stem associated with the top section of the platform; and a strap fastener, said strap fastener having a first wing and a second wing, wherein the strap fastener is attached to an upper end of the stem.

10. The footwear apparatus according to clause 9, further comprising an ornamental base associated with the strap fastener.

11. The footwear apparatus of according to clause 10, wherein said ornamental base is shaped according to a profile of the strap fastener.

12. The footwear apparatus according to clause 10, wherein a decorative item is affixed to ornamental base.

13. The footwear apparatus according to clauses 9-12, further comprising a gap formed between the ornamental base and the strap fastener.

14. The footwear apparatus according to clauses 9-13, further comprising a self-adhesive material applied to the distal end of the first strap and to the distal end of the second strap.

15. The footwear apparatus according to clauses 9-14, wherein the first wing and the second wing each include an opening sized to receive one of the distal end of the first strap and the distal end of the second strap.

16. The footwear apparatus according to clauses 9-15, further comprising a recessed slot formed in the top section of the platform for receipt of a multiple toe separator.

17. The footwear apparatus according to clause 16, wherein the multiple toe separator includes a plurality of toe separators having a base area and a plurality of vertical members detachably inserted in the recessed slot.

18. The footwear apparatus according to clause 16, wherein the recessed slot is of a depth substantially equal to the height of the toe separator base area.

19. The footwear apparatus according to clauses 9-18, wherein the stem includes a tapered base section having a rear facing width greater than a forward facing width.

20. The footwear apparatus according to clause 19, wherein the tapered base section is offset from an upper end of the stem along a longitudinal axis of the platform.

21. A footwear apparatus, comprising:

a sole having an upper portion and a side portion;

a strap affixed to the platform;

a strap fastener having at least one opening for receipt of the strap;

a recessed slot formed in the upper portion of the sole; and a plurality of toe separators having a base area and a plurality of vertical members detachably inserted in the recessed slot.

22. The footwear apparatus according to clause 21, wherein the recessed slot is of a depth substantially equal to the height of the toe separator base area.

23. The footwear apparatus according to clauses 21-22, further comprising a stem having a tapered base section having a rear facing width greater than a forward facing width.

24. The footwear apparatus according to clause 23, wherein the tapered base section is offset from an upper end of the stem along a longitudinal axis of the platform.

25. The footwear apparatus according to clauses 21-24, further comprising a self-adhesive material applied to the distal end of the first strap and to the distal end of the second strap.

26. A footwear apparatus, comprising:

a platform having a top section, a bottom section, and a side wall;

a first strap associated with the platform, said first strap having a proximal end and a distal end;

a second strap associated with the platform, said second strap having a proximal end and a distal end;

a first aperture associated with the distal end of the first strap;

a second aperture associated with the distal end of the second strap;

a stem associated with the top section of the platform, said stem having an interior threaded nut section on the stem's upper end;

a stem cap having a threaded end and a stopper; and a recessed slot formed in the top section sized for receipt of a multiple toe separator.

27. The footwear apparatus according to clause 26, wherein the threaded end of the stem cap is receivable by the interior threaded nut section attached to the stem's upper end.

28. The footwear apparatus according to clauses 26-27, further comprising a stopper associated with the stem cap, wherein the stopper provides a lower boundary of a gap.

29. The footwear apparatus according to clauses 26-28, further comprising a gap associated with the stem cap, wherein the distal end of the first strap is positioned thereon to secure the stem cap to the sandal.

30. The footwear apparatus according to clauses 26-29, wherein the stem includes a tapered base section having a rear facing width greater than a forward facing width.

31. The footwear apparatus according to clauses 26-30, wherein the tapered base section is offset from the threaded upper end of the stem along a longitudinal axis of the platform.

32. A footwear apparatus, comprising:
a platform having a top section, a bottom section, and a side wall;
a first strap associated with the platform, said first strap having a proximal end and a distal end;
a second strap associated with the platform, said second strap having a proximal end and a distal end;
a first aperture associated with the distal end of the first strap;
a second aperture associated with the distal end of the second strap;
a stem associated with the top section of the platform, said stem having a threaded section on the stem's upper end;
a stem cap having an interior threaded nut section and a stopper; and
a recessed slot formed in the top section sized for receipt of a multiple toe separator.
33. The footwear apparatus according to clause 32, wherein the threaded section of the stem is receivable by the interior threaded nut section of the stem cap.
34. The footwear apparatus according to clauses 32-33, further comprising a stopper associated with the stem cap, wherein the stopper provides a lower boundary of a gap.
35. The footwear apparatus according to clauses 32-34, further comprising a gap associated with the stem cap, wherein the distal end of the first strap is positioned thereon to secure the stem cap to the sandal.
36. The footwear apparatus according to clauses 32-35, wherein the stem includes a tapered base section having a rear facing width greater than a forward facing width.
37. The footwear apparatus according to clauses 32-36, wherein the tapered base section is offset from the threaded upper end of the stem along a longitudinal axis of the platform.

What is claimed is:

1. A footwear apparatus, comprising:
a platform having a top section, a bottom section, and a side wall;
a first strap associated with the platform, said first strap having a proximal end and a distal end;
a second strap associated with the platform, said second strap having a proximal end and a distal end;
a first aperture associated with the distal end of the first strap;
a second aperture associated with the distal end of the second strap;
a stem associated with the top section of the platform, said stem having a threaded upper end;
a stem cap having a threaded section; and
a recessed slot formed in the top section sized for receipt of a multiple toe separator.

2. The footwear apparatus of claim 1, wherein the threaded upper end of the stem is receivable by an interior threaded section of the stem cap.

3. The footwear apparatus of claim 1, wherein the threaded section of the stem cap is receivable by an interior threaded upper end of the stem.

4. The footwear apparatus of claim 1, further comprising a stopper associated with the stem cap, wherein the stopper provides a lower boundary of a gap.

5. The footwear apparatus of claim 4, wherein at least one of the distal end of the first strap and the second strap occupies the gap when the stem cap is engaged with the threaded upper end of the stem.

6. The footwear apparatus of claim 4, wherein the at least one of the distal end of the first strap and the second strap occupies the gap when the stem cap is disengaged from the threaded upper end of the stem.

7. The footwear apparatus of claim 1, wherein the stem includes a tapered base section having a rear facing width greater than a forward facing width.

8. The footwear apparatus of claim 7, wherein the tapered base section is offset from the threaded upper end of the stem along a longitudinal axis of the platform.

9. The footwear apparatus of claim 1, further comprising a recessed slot formed in the top section of the platform for receipt of a multiple toe separator.

10. The footwear apparatus of claim 9, wherein the multiple toe separator includes a plurality of toe separators having a base area and a plurality of vertical members detachably inserted in the recessed slot.

11. The footwear apparatus of claim 10, wherein the recessed slot is of a depth substantially equal to the height of the toe separator base area.

* * * * *